US006626124B2

(12) United States Patent
Nakajima et al.

(10) Patent No.: US 6,626,124 B2
(45) Date of Patent: Sep. 30, 2003

(54) ARTICLE STORAGE STRUCTURE FOR A SMALL BOAT

(75) Inventors: Jun Nakajima, Saitama (JP); Tadaaki Nagata, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/231,095

(22) Filed: Aug. 30, 2002

(65) Prior Publication Data

US 2003/0066474 A1 Apr. 10, 2003

(30) Foreign Application Priority Data

Sep. 6, 2001 (JP) ..... 2001-269882

(51) Int. Cl.[7] ..... B63B 8/00
(52) U.S. Cl. ..... 114/343; 114/55.53
(58) Field of Search ..... 114/343, 364, 114/55.53, 55.57, 55.5, 55.51

(56) References Cited

U.S. PATENT DOCUMENTS 6,276,290 B1 * 8/2001 Yamada et al. ..... 114/55.51

FOREIGN PATENT DOCUMENTS

JP 10-119882 A 5/1998

* cited by examiner

*Primary Examiner*—Ed Swinehart
(74) *Attorney, Agent, or Firm*—Birch, Stewart, Kolasch & Birch, LLP

(57) ABSTRACT

To provide an article storage structure for a small boat having a reduced number of components and being able to be assembled without much time and effort. The article storage structure for a small boat is constructed in such a manner that a storing box body is supported so as to be capable of being opened and closed in the vertical direction by swinging a lid by a front hinge. The front hinge includes a bearing bracket mounted on the lid. A round hole is formed on the bearing bracket. A notch is provided continuing into the round hole. A bifacial shaft has an outer diameter corresponding to the round hole and is formed with two faces each having a width corresponding to the width of the slit by notching. A leg portion is provided for fixing the bifacial shaft to the hull. A retaining member is provided for preventing the notch and the bifacial shaft from establishing an angular relation in which they can be attached and detached with each other when the notch is rotated about the bifacial shaft.

20 Claims, 6 Drawing Sheets

ARTICLE STORAGE STRUCTURE FOR A SMALL BOAT

CROSS-REFERENCE TO RELATED APPLICATIONS

This application claims priority under 35 U.S.C. §119 on application Ser. No. 2001-269882, filed in Japan on Sep. 6, 2001, the entirety of which is hereby incorporated by reference.

BACKGROUND OF THE INVENTION

1. Field of the Invention

The present invention relates to an article storage structure for a small boat including a handle at a front portion of the hull, and an article storage box provided at the back of the handle.

2. Description of Background Art

A jet propulsion boat is a vessel, which is provided with a jet pump mounted at a rear portion of the hull. A jet propulsion boat is propelled by sucking water from the vessel bottom by driving the jet pump with an engine and splashing or spraying the sucked water rearward.

A jet propulsion boat is disclosed, for example, in JP-A-10-119882 entitled "STORAGE DEVICE FOR PROPULSION BOAT." The jet propulsion boat in this publication includes a handle in front of the hull, a seat at the back of the handle, and a dough box (article storage box) between the seat and the handle.

The article storage box includes a dough box body embedded at the back of the handle in the hull. An opening is provided at the upper end of the article storage box body, wherein the opening is arranged flush with the hull. The lid body is disposed on the opening.

By attaching the front end of the lid body rotatably on the hull via a hinge, the opening of the article storage box body can be opened and closed by swinging the lid body in the vertical direction.

In this way, the front end of the lid body is attached to the hull by means of a hinge for allowing a vertical swinging motion of the lid body. As an example, the hinge is constructed in such a manner that a bearing is formed on the hull side and a bearing is formed also at the front end of the lid body. A shaft is inserted into the bearings so as to allow the lid body to swing about the shaft freely. A cotter pin is attached at the end of the shaft so as to prevent the inserted shaft from being detached.

In other words, in order to attach the lid body to the hull so as to be capable of swinging freely, members such as the shaft and the cotter pin are required. Therefore, the number of components increases. In addition, since the number of the components is large, assembling of the hinge needs much time and effort.

Accordingly, it is difficult to lower the cost of the hinge because the number of components constituting the hinge is large and assembling thereof needs much time and effort.

SUMMARY OF THE INVENTION

Accordingly, it is an object of the present invention to provide an article storage structure for a small boat having a reduced number of components and being able to be assembled with less time and effort.

In order to solve the problem, the present invention is directed to a small boat including a bar-type handle disposed on the centerline along the length of the hull, an article storage box having a front hinge at the back of the handle and a lid that can be opened and closed in the vertical direction, and a seat disposed at the back of the article storage box, the front hinge includes a keyhole-shaped notch formed having a slit with a width smaller than an inner diameter of a round hole and continuing into the round hole, a bifacial shaft having an outer diameter corresponding to the round hole and being formed with two faces forming a width corresponding to the width of the slit, and a retaining member for preventing the keyhole-shaped notch and the bifacial shaft from establishing an angular relation in which they can be attached and detached with each other when the keyhole-shaped notch is rotated about the bifacial shaft, wherein the retaining member is disposed in the vicinity of the handle and one of the keyhole-shaped notch and the bifacial shaft is provided on the lid and the other one is provided on the hull side.

The round hole and the keyhole-shaped notch continuing into the round hole are provided on one of the hull and the lid, and the bifacial shaft is provided on the other one of those. By inserting the keyhole-shaped notch along the two faces of the bifacial shaft, the bifacial shaft is disposed in the round hole.

After setting the bifacial shaft into the round hole, the retaining member can prevent the keyhole-shaped notch and the bifacial shaft from establishing an angular relation in which they can be attached and detached with each other. As a consequence, the lid can be opened and closed in the vertical direction about the bifacial shaft.

Since the bifacial shaft can be disposed in the round hole only by inserting the keyhole-shaped notch along the two faces of the bifacial shaft, assembly of the lid can be facilitated.

In addition, the bifacial shaft can be disposed in the round hole only by inserting the keyhole-notch along the two faces of the bifacial shaft. Accordingly, the bifacial shaft can be fixed in advance to the other one of the hull and the lid. Therefore, the cotter pin that is required for preventing the bifacial shaft from being detached can be eliminated and thus the number of the components of the hinge can be reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
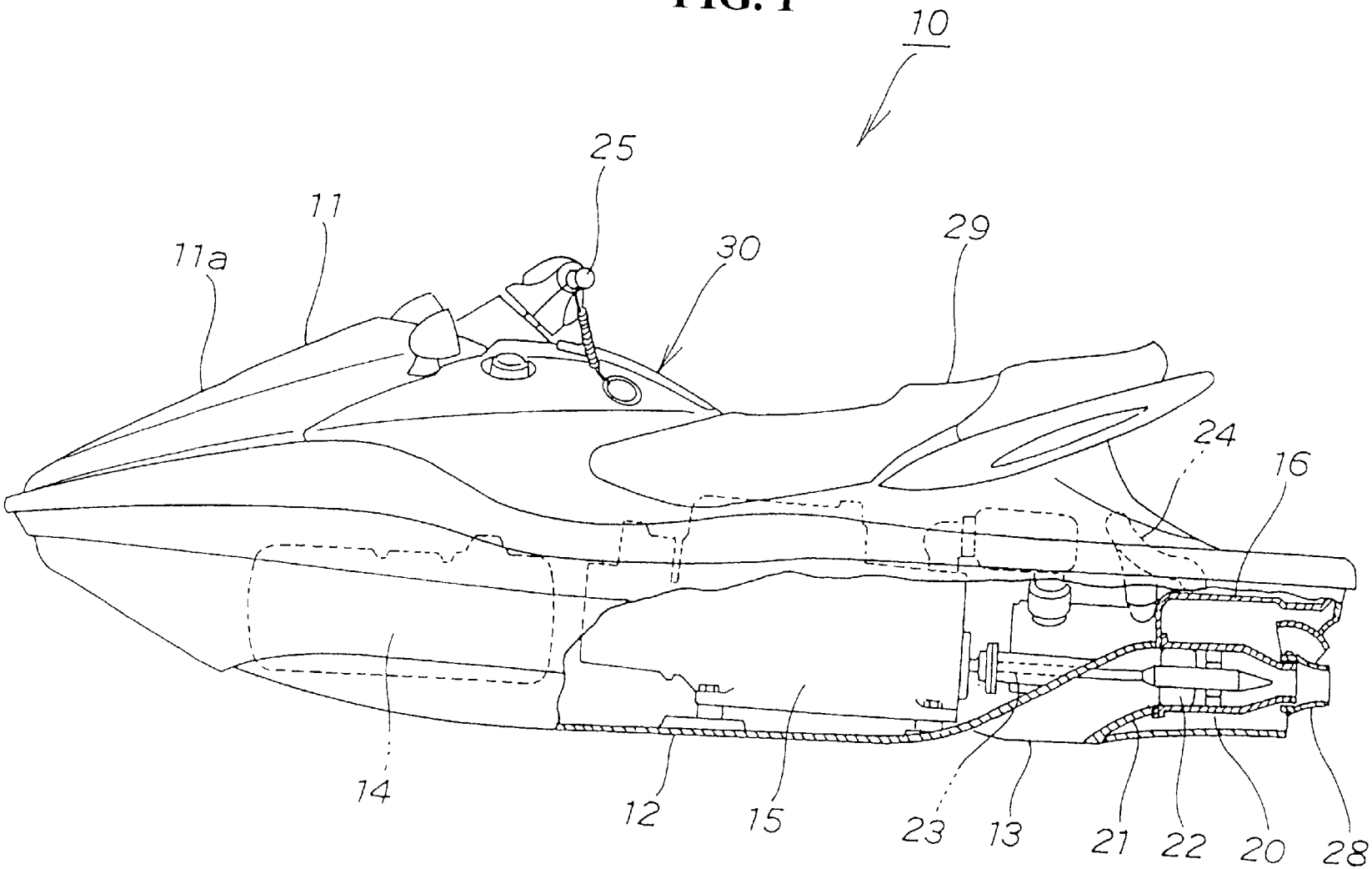
FIG. 1 is a side view of a small boat provided with an article storage structure according to the present invention.

The present invention will now be described with reference to the accompanying drawings. The drawings should be viewed in the direction of the orientation of the reference numerals. Although the present invention can be applied to any small boat, a jet propulsion boat will now be described as an example.

FIG. 1 is a side view of a small boat including an article storage structure according to the present invention. The jet propulsion boat 10 includes a fuel tank 14 mounted at the front portion 11*a* of the hull 11. An engine 15 is provided at the back of the fuel tank 14. A pump chamber 16 is provided at the back of the engine 15. A jet pump 20 is provided in the pump chamber 16. An exhaust pipe 24 is attached to the engine 15 on the air intake side and to the pump chamber 16 on the exhaust side. A bar-type steering handle or handlebar (handle hereinafter) 25 is disposed on a center line along the length of the hull 11. An article storage structure 30 for a small boat is provided at the back of the steering handle 25. A seat 29 is disposed to the back of the article storage structure 30.

The jet pump 20 includes a housing 21 extending rearward from the opening 13 of the vessel bottom 12. An impeller 22 is rotatably mounted in the housing 21 and is connected to the drive shaft 23 of the engine 15.

With the jet pump 20, water sucked from the opening 13 of the vessel bottom 12 can be splashed via the rear end opening of the housing 21 from the steering nozzle 28 to the rear of the hull 11 by driving the engine 15 and rotating the impeller 22.

The vessel 10 can be propelled by supplying fuel from the fuel tank 14 to the engine 15 to drive the engine 15, transmitting a driving force of the engine 15 to the impeller 22 via the drive shaft 23, sucking water from the opening 13 of the vessel bottom 12 by rotating the impeller 22, and splashing sucked water through the rear end of the housing 21 from the steering nozzle 28.

Figure 2:
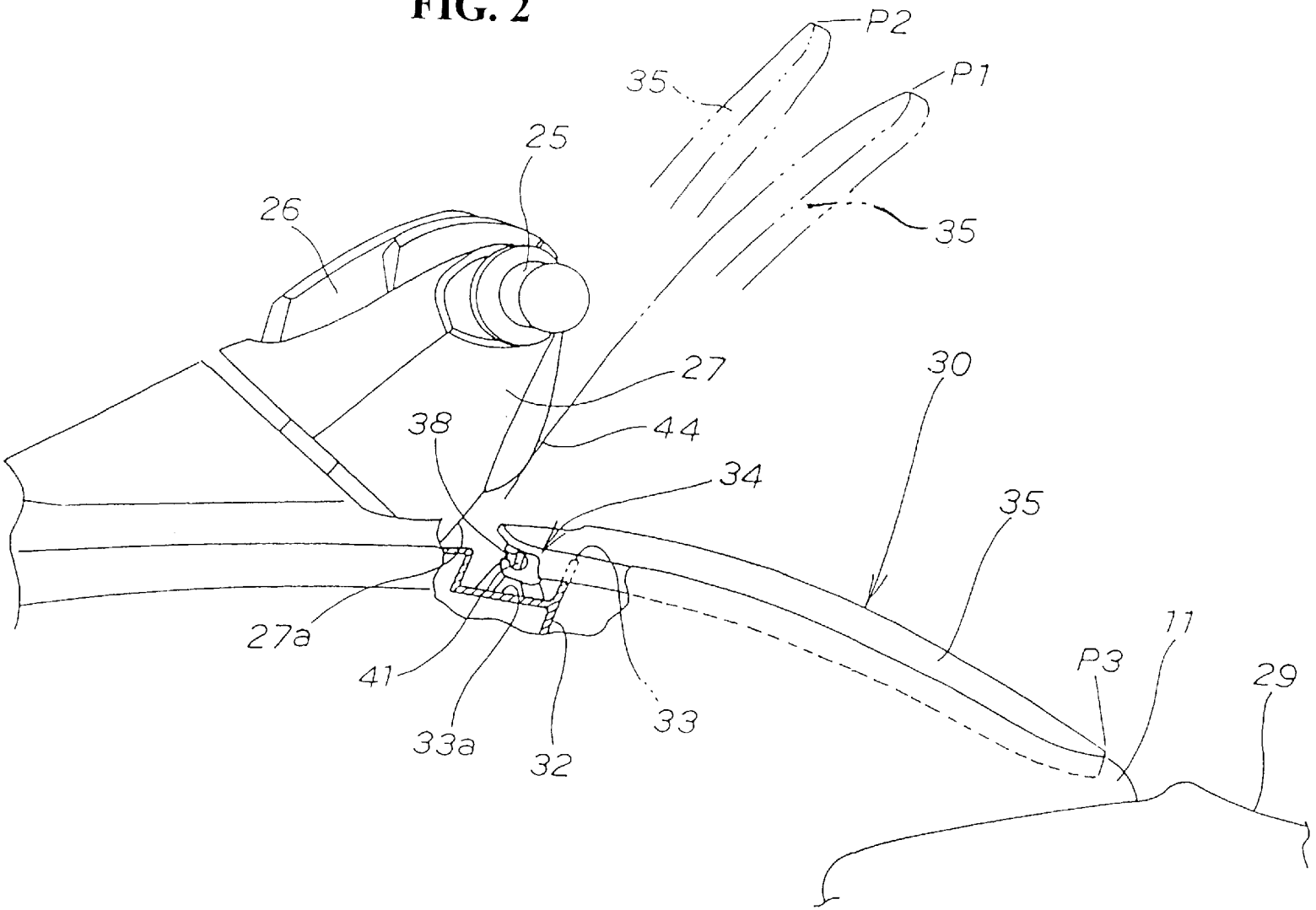
FIG. 2 is a side view of the article storage structure for a small boat according to the present invention.

FIG. 2 is a side view of the article storage structure for a small boat according to the present invention showing a state in which the bar-type steering handle 25 can be covered by the handle front cover 26 and the handle rear cover 27 from the front and back. The article storage structure 30 for a small boat is provided at the rear of the handle rear cover 27.

The article storage structure 30 for a small boat includes a storage box body 32 of an article storage box embedded in the hull 11 in the vicinity of a lower end 27*a* of the handle rear cover 27 (that is, the back of the steering handle 25). A front hinge 34 is provided at a front portion 33*a* of an opening 33 of the storage box body 32. The storage box body 32 is supported so as to be capable of being opened and closed by swinging a lid 35 in the vertical direction with the front hinge 34. A retaining member 44 is provided for keeping the lid 35 stationary at a prescribed opened position P1 (rear surface of the handle rear cover 27).

Figure 3:
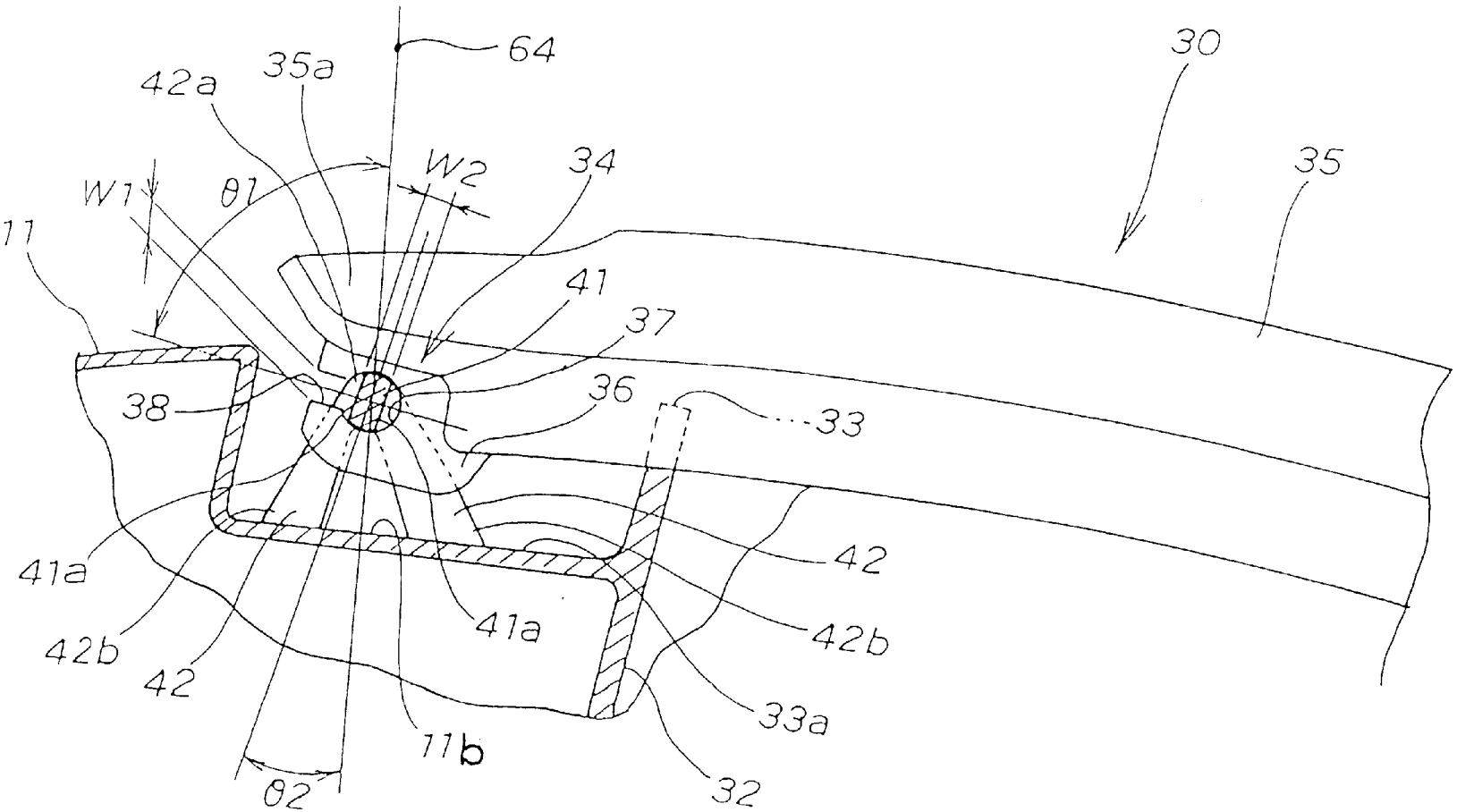
FIG. 3 is an enlarged view of a principal portion of the article storage structure for a small boat according to the present invention.

FIG. 3 is an enlarged view of a principal portion of the article storage structure for a small boat according to the present invention. The front hinge 34 includes a bearing bracket 36 mounted at the front end 35*a* of the lid 35. A round hole 37 is formed on the bearing bracket 36. A keyhole-shaped notch 38 is formed from a slit having a width W1 smaller than the diameter of the round hole 37 and continuing into the round hole (hereinafter referred to as a "notch"). A bifacial shaft 41 has an outer diameter corresponding to the round hole 37 and is formed with two faces 41*a*, 41*a* forming a width W2 corresponding to the width W1 of the slit by notching. A leg portion 42 is provided for fixing the bifacial shaft 41 to the upper shoulder 11*b* (that is, the portion corresponding to the front portion 33*a* of the opening 33) of the hull 11.

With the hinge 34, the lid 35 can be swung in the vertical direction by rotating the notch 38 about the bifacial shaft 41. In addition, since the retaining member 44 is provided on the article storage structure 30 for a small boat (rear end surface of the handle rear cover 27 (See FIG. 2)), the lid 35 can be abutted against the retaining member 44 when opening the lid 35 as described in conjunction with FIG. 2. As a consequence, the notch 38 and the bifacial shaft 41 can be prevented from establishing an angular relation in which they can be attached and detached from each other.

The round hole 37 is a hole having a diameter slightly larger than the outer diameter of the bifacial shaft 41. The axis of the bifacial shaft 41 extends in a direction orthogonal to the figure along the surface of the hull 11.

The notch 38 is formed by continuing a slit having a width W1 smaller than the diameter of the round hole 37 into the round hole 37 so as to open the round hole 37. The slit is formed so as to incline toward the front by an angle θ1 with respect to a vertical line 46.

The bifacial shaft 41 is a member in which the width W2 formed between the two faces 41*a*, 41*a* is smaller than the width W1 of the notch 38. Two faces 41*a*, 41*a* are inclined rearwardly by an angle θ2 with respect to the vertical line 46.

The leg portion 42 is a member formed into a substantially inverted V-shape, having a bifacial shaft 41 integrally formed therewith on a top 42*a* thereof. A base 42*b* is formed on an upper shoulder 11*b* (that is, the portion corresponding to the front portion 33*a* of the opening 33) of the hull 11.

Referring back to FIG. 2, when the lid 35 is lifted to the detachable position P2 (shown in phantom line) by swinging it to the opening direction, the notch 38 becomes parallel with the two surfaces 41*a*, 41*a* of the bifacial shaft 41 (See FIG. 3). Therefore, the notch 38 is slidable along the two faces 41*a*, 41*a* of the bifacial shaft 41, and thus the bearing bracket 36 is detachable from the bifacial shaft 41. The lid 35 is movable to the detachable position P2 when the handle rear cover 27 has been removed.

Therefore, the retaining member 44 is provided in the vicinity of the tip of the lid 35 by forming the retaining member 44 on the back surface of the handle rear cover 27. As a consequence, the lid 35 is adapted to remain stationary at the opening position P1 behind the detachable position P2 by the rear surface of the handle rear cover 27, that is, the retaining member 44.

The operation of the article storage structure 30 for a small boat will now be described referring to FIG. 4 to FIG. 6.

Figures 4A, 4B, 4C:
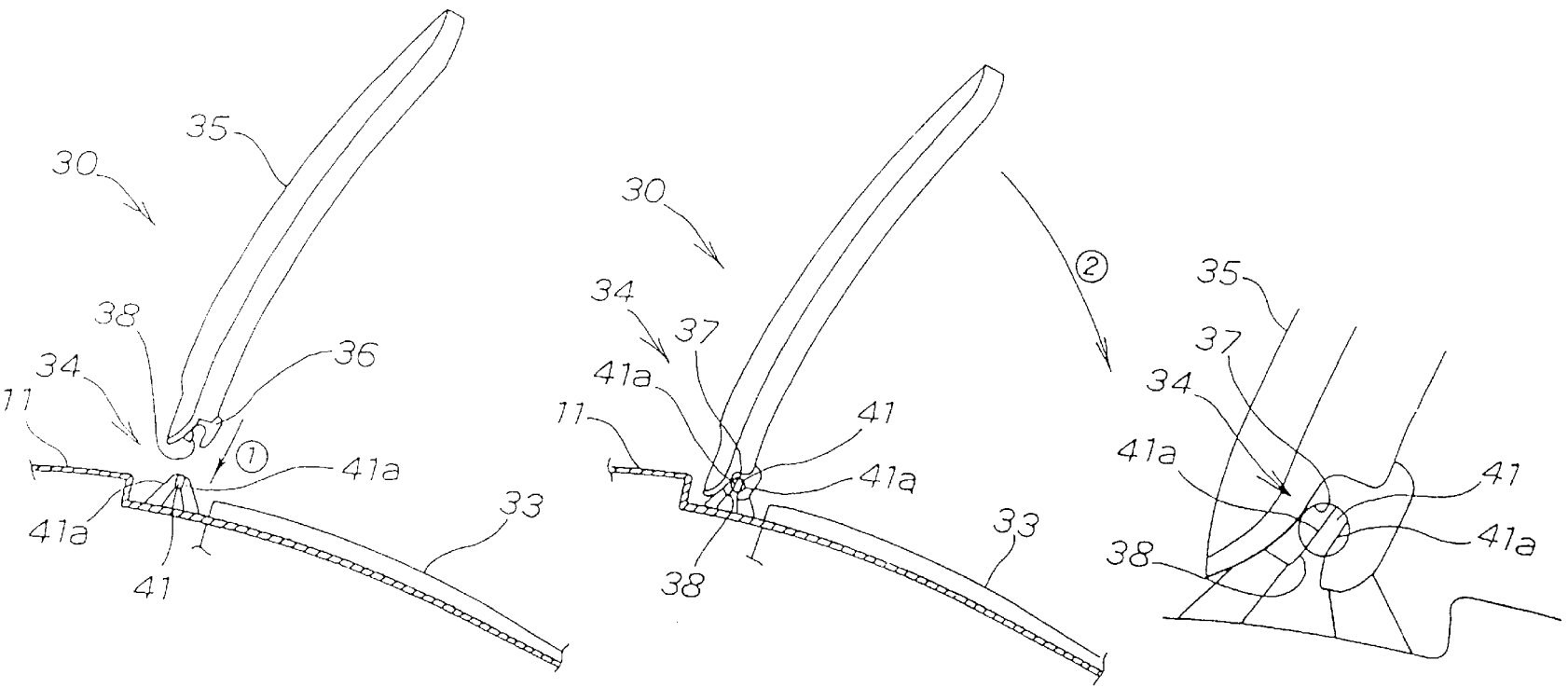
FIGS. 4(*a*) to 4(*c*) are first explanatory drawings illustrating the operation of the article storage structure for a small boat according to the present invention.

FIGS. 4(*a*) to 4(*c*) are first explanatory drawings illustrating the operation of the article storage structure for a small boat according to the present invention. FIG. 4(*c*) is an enlarged view of a portion of FIG. 4(*b*).

In FIG. 4(*a*), the notch 38 of the bearing bracket 36 of the lid 35 is inclined so as to be in parallel with the two faces 41*a*, 41*a* of the bifacial shaft 41. In this state, the lid 35 is disposed above the bifacial shaft 41. Subsequently, the lid 35 is moved toward the bifacial shaft 41 as shown by the arrow ①.

In FIG. 4(*b*), the notch 38 is fitted along the two faces 41*a*, 41*a* of the bifacial shaft 41, and the bifacial shaft 41 is disposed in the round hole 37 which is in communication with the notch 38.

FIG. 4(*c*) shows a state in which the bifacial shaft 41 is inserted into the round hole 37 with the notch 38 in parallel with the two faces 41*a*, 41*a* of the bifacial shaft 41. In this state, the lid 35 can be swung about the bifacial shaft 41.

Returning back to FIG. 4(*b*), the lid 35 is swung downward as shown by the arrow ②.

Figure 5A:
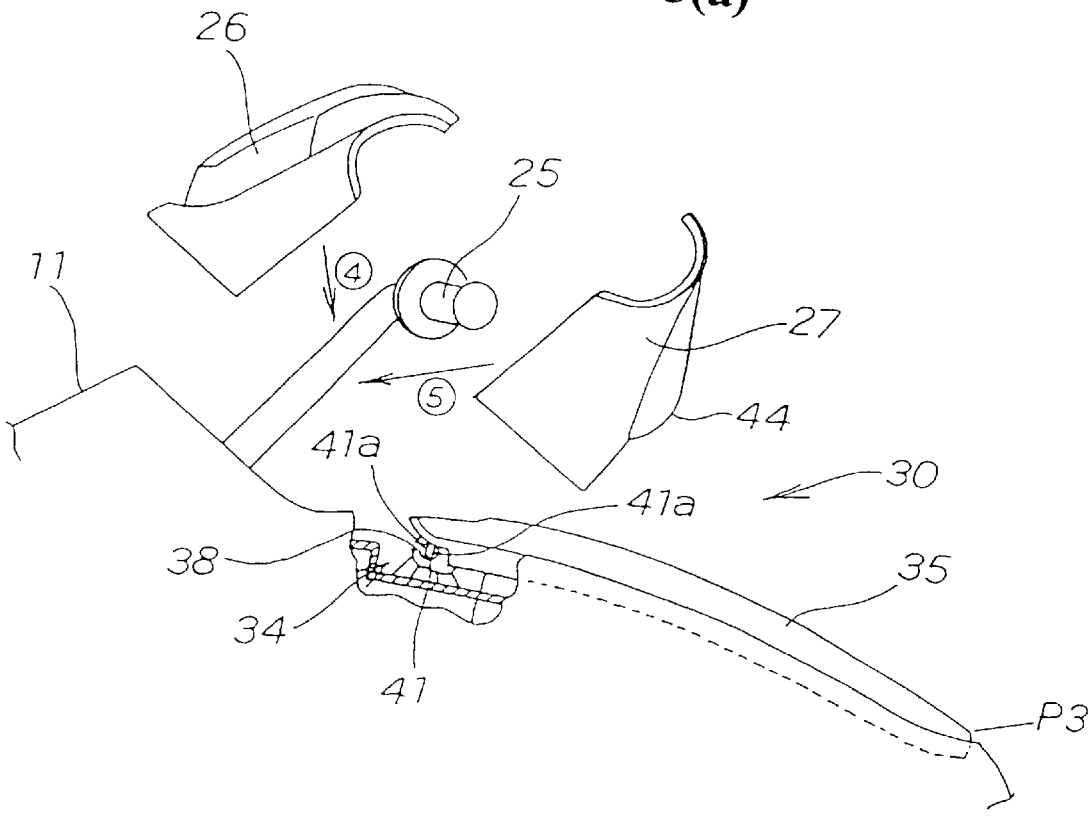
FIGS. 5(*a*) and 5(*b*) are second explanatory drawings illustrating the operation of the article storage structure for a small boat according to the present invention.
Figure 5B:
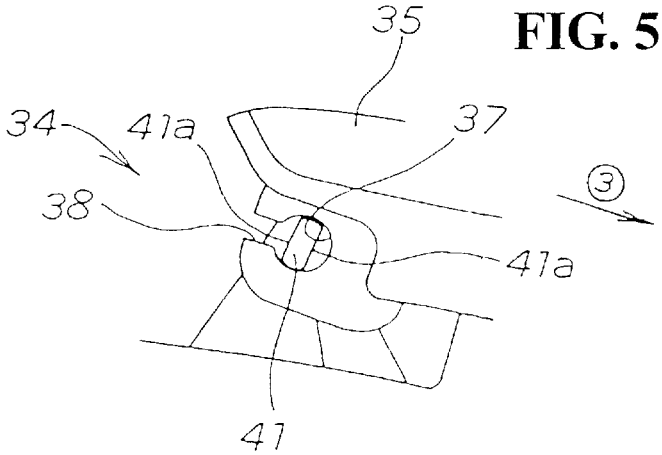

FIGS. 5(*a*) and 5(*b*) are the second explanatory drawings illustrating the operation of the article storage structure for a small boat according to the present invention. FIG. 5(*b*) is an enlarged view showing a portion of FIG. 5(*a*).

In FIG. 5(*a*), the lid 35 is disposed flush with the surface of the hull 11 by swinging the lid 35 to the closed position P3.

In FIG. 5(*b*), the notch 38 faces toward one of the faces 41*a* of the bifacial shaft 41 in a state in which the lid 35 remains stationary in the closed position P3. Therefore, in the unlikely event that a force in the direction to detach the lid 35 from the bifacial shaft 41 is exerted on the lid 35 as shown by the arrow ③, the bifacial shaft 41 is prevented from coming out of the round hole 37. Thus, the lid 35 cannot be detached from the bifacial shaft 41.

Referring back to FIG. 5(*a*), the handle front cover 26 is attached on the front of the steering handle 25 as shown by the arrow ④. The handle rear cover 27 is attached on the back side of the steering handle 25 as shown by the arrow ⑤. Accordingly, the shaft portion 25*a* of the steering handle 25 can be covered by the handle front cover 26 and the handle rear cover 27.

Figure 6A:
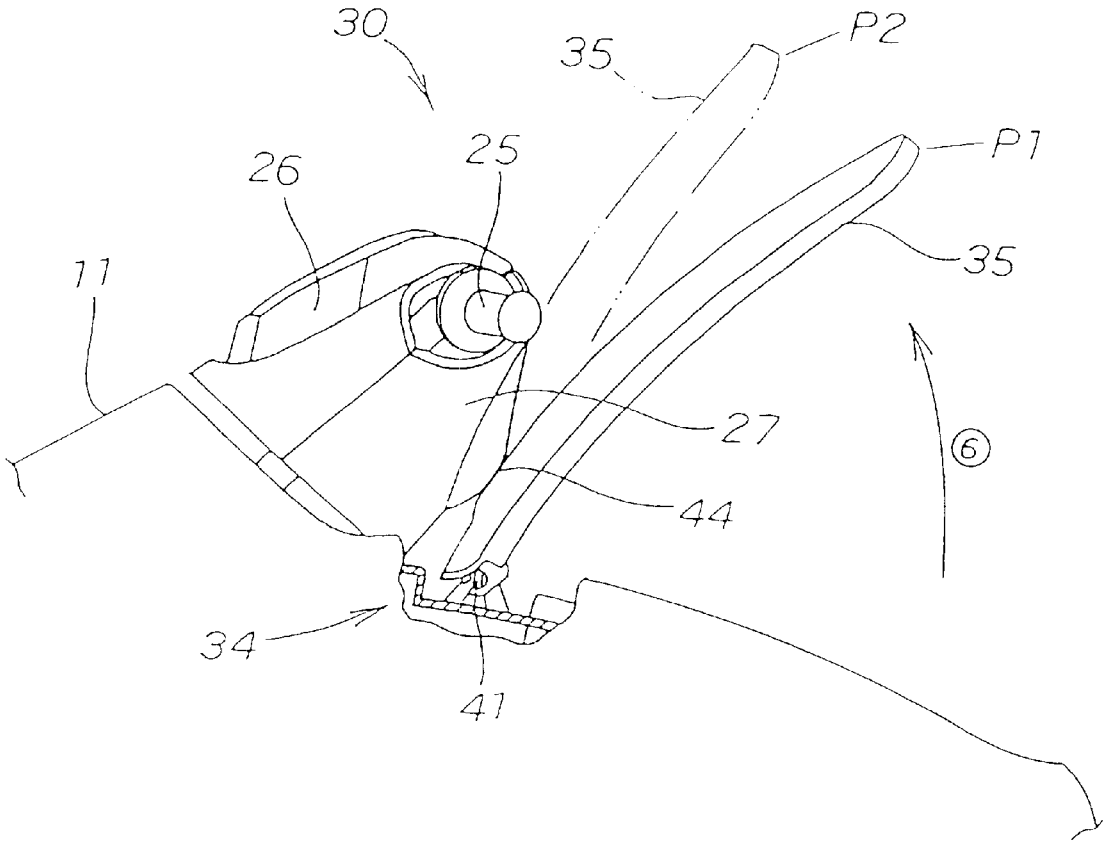
FIGS. 6(*a*) and 6(*b*) are third explanatory drawing illustrating the operation of the article storage structure for a small boat according to the present invention.
Figure 6B:
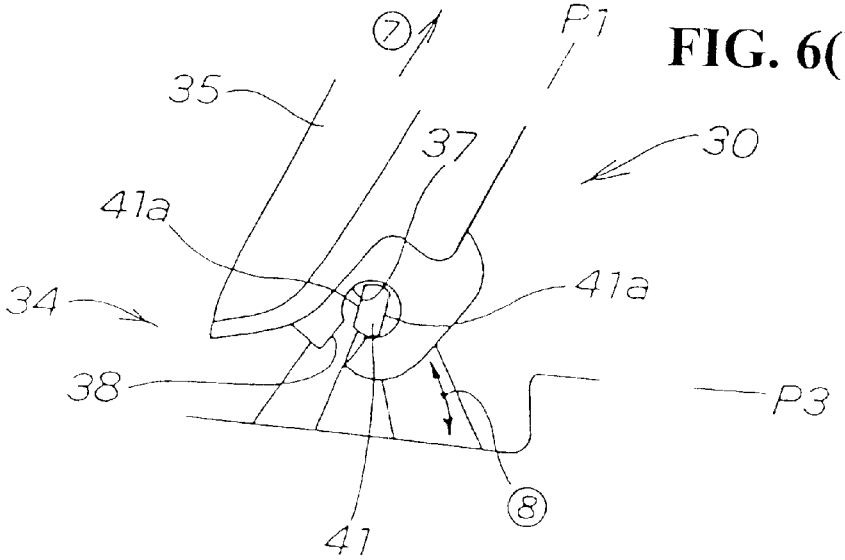

FIGS. 6(*a*) and 6(*b*) are the third explanatory drawings illustrating the operation of an article storage box for a small boat according to the present invention. FIG. 6(*b*) is an enlarged view of a portion of FIG. 6(*a*).

In FIG. 6(*a*), when the lid 35 is swung upward in the opening direction as shown by the arrow ⑥ and the lid 35 reaches the opened position P1, the lid 35 abuts against the rear surface of the handle rear cover 27, that is, the retaining member 44. Accordingly, the lid 35 remains stationary in the opened position P1.

In FIG. 6(*b*), the notch 38 is out of alignment with respect to the two faces 41*a*, 41*a* of the bifacial shaft 41 with the lid 35 remaining stationary at the opened position P1. Therefore, in the unlikely event that a force in the direction of detaching the lid 35 from the bifacial shaft 41 is exerted to the lid 35 as shown by the arrow ⑦, the bifacial shaft 41 can be prevented from coming out of the round hole 37. Thus, the lid 35 cannot be detached from the bifacial shaft 41.

As described above, even when the lid 35 is opened to the opened position P1, the lid 35 can be maintained in a state of being attached to the bifacial shaft 41. Therefore the lid 35 can be moved between the opened position P1 and the closed position P3 by swinging in the direction of the arrow ⑧ as appropriate.

As described above, according to the article storage structure 30 for a small boat, the round hole 37 and the notch 38 continuing into the round hole 37 are provided on the lid 35 side. The bifacial shaft 41 is provided on the hull 11 side. The bifacial shaft 41 can be disposed in the round hole 37 by fitting the notch 38 along the two surface 41*a*, 41*a* of the bifacial shaft 41.

On the other hand, after the bifacial shaft 41 is disposed in the round hole 37, the retaining member 44 can prevent the notch 38 and the bifacial shaft 41 from establishing an angular relation in which they can be attached and detached with each other. As a consequence, the lid 35 can be opened and closed in the vertical direction about the bifacial shaft 41.

Therefore, since the bifacial shaft 41 can be disposed in the round hole 37 only by fitting the notch 38 along the two faces 41*a*, 41*a* of the bifacial shaft 41, assembling of the lid 35 can be facilitated.

In addition, since the bifacial shaft 41 can be disposed in the round hole 37 only by fitting the notch 38 along the two faces 41*a*, 41*a* of the bifacial shaft 41, the bifacial shaft 41 can be secured in advance to the hull 11 side.

Therefore, the cotter pin required for preventing the bifacial shaft 41 from being detached can be eliminated, and thus the number of the components of the front hinge 34 can be reduced.

In the aforementioned embodiment, although an example in which a round hole 37 and the notch 38 continuing into the round hole 37 is provided on the lid 35 side and the bifacial shaft 41 is provided on the hull 11 side has been described, it is not limited thereto. The same effects can be exercised where the round hole 37 and the notch 38 continuing into the round hole 37 are provided on the hull 11 side and the bifacial shaft 41 is provided on the lid 35 side.

Furthermore, in the aforementioned embodiment, although an example in which the handle rear cover 27 is used as a retaining member 44 has been described, it is not limited thereto. It is possible to use other members as the retaining member 44. In addition, it is also possible to newly add a retaining member 44 as a specific member.

Furthermore, in the aforementioned embodiment, although a jet propulsion boat 10 that is propelled by a jet pump is exemplified and described as a small boat, the propelling means for the small boat is not limited thereto.

In addition, in the aforementioned embodiment, although the bifacial shaft 41 integrally formed on the top 42*a* of the leg portion 42 is exemplified and described as a small boat, it is not limited thereto. It is also possible to attach the bifacial shaft 41 to the top 42*a* of the leg portion 42 with a fastening member.

The present invention thus constructed exercises the following effects.

According to the first aspect of the present invention, a round hole and a keyhole-shaped notch continuing into the round hole are provided on one of the hull and the lid, and a bifacial shaft is provided on the other one. The bifacial shaft can be disposed in the round hole by fitting the keyhole-shaped notch along the two faces of the bifacial shaft.

In addition, after the bifacial shaft is set into the round hole, the retaining member can prevent the keyhole-shaped notch and the bifacial shaft from establishing an angular relation in which they can be attached and detached from each other. As a consequence, the lid can be opened and closed in the vertical direction about the bifacial shaft.

Since the bifacial shaft can be disposed in the round hole only by inserting the keyhole-shaped notch along the two faces of the bifacial shaft, assembling of the lid can be facilitated.

In addition, since the bifacial shaft can be disposed in the round hole only by inserting the keyhole-notch along the two faces of the bifacial shaft, the bifacial shaft can be fixed in advance to the other one of the hull and the lid. Therefore, the cotter pin that is required for preventing the bifacial shaft from being detached can be eliminated and thus the number of the components of the hinge can be reduced.

In this way, since assembly of the lid can be facilitated and the number of components of the hinge can be reduced, the cost of the article storage structure can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An article storing structure in a small boat, the small boat including a handlebar disposed on a centerline along a length of a hull of the small boat and a seat disposed rearward of the handlebar, said article storing structure comprising:

an article storage box;

a front hinge, said front hinge being disposed rearward of the handlebar and forward of the seat, said front hinge including:

a keyhole-shaped notch, said keyhole-shaped notch being formed of a slit having a width smaller than an inner diameter of a round hole, said slit continuing into the round hole; and a bifacial shaft, said bifacial shaft having an outer diameter corresponding to the round hole, said bifacial shaft being formed with two faces forming a width corresponding to the width of the slit;

a lid, said lid being openable and closeable in a vertical direction by said front hinge; and a retaining member, said retaining member preventing the keyhole-shaped notch and the bifacial shaft from establishing an angular relation in which the keyhole-shaped notch and the bifacial shaft can be attached and detached from each other when the keyhole-shaped notch is rotated about the bifacial shaft;

wherein said retaining member is disposed in a vicinity of said handle and one of the keyhole-shaped notch and the bifacial shaft is provided on the lid and the other one of the keyhole-shaped notch and the bifacial shaft is provided on the hull.

2. The article storage structure in a small boat according to claim 1, further comprising:

a handle front cover, said handle front cover being removably attached to a front of the handle; and a handle rear cover, said handle rear cover being removably attached to a rear of said handle, wherein a rear surface of said handle rear cover forms said retaining member.

3. The article storage structure in a small boat according to claim 2, wherein when said handle rear cover is in a removed position, said slit of said keyhole-shaped notch can be aligned with said two faces of said bifacial shaft to remove said bifacial shaft from said key-hole shaped notch to thereby remove said lid.

4. The article storage structure in a small boat according to claim 1, wherein said keyhole-shaped notch is provided on said lid and said bifacial shaft is provided on the hull.

5. The article storage structure in a small boat according to claim 2, wherein said keyhole-shaped notch is provided on said lid and said bifacial shaft is provided on the hull.

6. The article storage structure in a small boat according to claim 3, wherein said keyhole-shaped notch is provided on said lid and said bifacial shaft is provided on the hull.

7. The article storage structure in a small boat according to claim 4, wherein said lid includes a bearing bracket formed thereon, said keyhole-shaped notch being formed in said bearing bracket, and said bifacial shaft is supported by a leg portion in spaced relation to said hull.

8. The article storage structure in a small boat according to claim 5, wherein said lid includes a bearing bracket formed thereon, said keyhole-shaped notch being formed in said bearing bracket, and said bifacial shaft is supported by a leg portion in spaced relation to said hull.

9. The article storage structure in a small boat according to claim 6, wherein said lid includes a bearing bracket formed thereon, said keyhole-shaped notch being formed in said bearing bracket, and said bifacial shaft is supported by a leg portion in spaced relation to said hull.

10. The article storage structure in a small boat according to claim 1, wherein when said lid is in the closed position, said slit of said keyhole-shaped notch is inclined toward the front at a predetermined angle to the vertical, and said two faces of said bifacial shaft are inclined toward the rear at a predetermined angle to the vertical.

11. An article storing structure for a small boat, comprising:

an article storage box;

a front hinge, said front hinge including:

a keyhole-shaped notch, said keyhole-shaped notch being formed of a slit having a width smaller than an inner diameter of a round hole, said slit continuing into the round hole; and a bifacial shaft, said bifacial shaft having an outer diameter corresponding to the round hole, said bifacial shaft being formed with two faces forming a width corresponding to the width of the slit;

a lid, said lid being openable and closeable in a vertical direction by said front hinge; and a retaining member, said retaining member preventing the keyhole-shaped notch and the bifacial shaft from establishing an angular relation in which the keyhole-shaped notch and the bifacial shaft can be attached and detached from each other when the keyhole-shaped notch is rotated about the bifacial shaft;

wherein one of the keyhole-shaped notch and the bifacial shaft is provided on the lid and the other one of the keyhole-shaped notch and the bifacial shaft is provided on a hull of the small boat.

12. The article storage structure according to claim 11, further comprising:

a handle front cover, said handle front cover being removably attached to a front of the handle; and a handle rear cover, said handle rear cover being removably attached to a rear of said handle, wherein a rear surface of said handle rear cover forms said retaining member.

13. The article storage structure according to claim 12, wherein when said handle rear cover is in a removed position, said slit of said keyhole-shaped notch can be aligned with said two faces of said bifacial shaft to remove said bifacial shaft from said key-hole shaped notch to thereby remove said lid.

14. The article storage structure according to claim 11, wherein said keyhole-shaped notch is provided on said lid and said bifacial shaft is provided on the hull.

15. The article storage structure according to claim 12, wherein said keyhole-shaped notch is provided on said lid and said bifacial shaft is provided on the hull.

16. The article storage structure according to claim 13, wherein said keyhole-shaped notch is provided on said lid and said bifacial shaft is provided on the hull.

17. The article storage structure according to claim 14, wherein said lid includes a bearing bracket formed thereon, said keyhole-shaped notch being formed in said bearing bracket, and said bifacial shaft is supported by a leg portion in spaced relation to said hull.

18. The article storage structure according to claim 15, wherein said lid includes a bearing bracket formed thereon, said keyhole-shaped notch being formed in said bearing bracket, and said bifacial shaft is supported by a leg portion in spaced relation to said hull.

19. The article storage structure according to claim 16, wherein said lid includes a bearing bracket formed thereon, said keyhole-shaped notch being formed in said bearing bracket, and said bifacial shaft is supported by a leg portion in spaced relation to said hull.

20. The article storage structure according to claim 11, wherein when said lid is in the closed position, said slit of said keyhole-shaped notch is inclined toward the front at a predetermined angle to the vertical, and said two faces of said bifacial shaft are inclined toward the rear at a predetermined angle to the vertical.

* * * * *